United States Patent [19]

Korte

[11] 4,252,307

[45] Feb. 24, 1981

[54] SHEET FEED AND TRANSPORT

[75] Inventor: Eugene C. Korte, Boulder, Colo.

[73] Assignee: International Business Machines Corporation, Armonk, N.Y.

[21] Appl. No.: 919,898

[22] Filed: Jun. 28, 1978

Related U.S. Application Data

[63] Continuation of Ser. No. 766,403, Feb. 7, 1977, abandoned.

[51] Int. Cl.[3] ..... B65H 5/12; B65H 9/06

[52] U.S. Cl. ..... 271/4; 271/195; 271/245; 271/270; 271/275; 271/276; 271/DIG. 2; 346/138

[58] Field of Search ..... 271/3, 4, 276, 196, 271/195, 270, 80, 275, 277, DIG. 2, 245, 246, 247, 194; 346/134, 138

[56] References Cited

U.S. PATENT DOCUMENTS

| | | | |
|---|---|---|---|
| 2,946,593 | 7/1960 | Beyer | 271/3 X |
| 3,323,794 | 6/1967 | Brandt | 271/277 |
| 3,351,340 | 11/1967 | Levine | 271/275 |
| 3,466,029 | 9/1969 | Jensen et al. | 271/276 |
| 3,506,259 | 4/1970 | Caldwell et al. | 271/80 X |
| 3,663,012 | 5/1972 | Van Den Honert | 271/276 |
| 3,784,190 | 1/1974 | Crawford | 271/80 |
| 3,804,401 | 4/1974 | Stange | 271/80 |
| 3,808,603 | 4/1974 | Degreve et al. | 346/138 |
| 3,843,114 | 10/1974 | Kojima et al. | 271/3 |
| 4,015,523 | 4/1977 | Evans et al. | 271/245 X |
| 4,085,673 | 4/1978 | Wierszewski | 271/247 X |

FOREIGN PATENT DOCUMENTS

| | | | |
|---|---|---|---|
| 1029990 | 6/1953 | France | 271/276 |

*Primary Examiner*—Bruce H. Stoner, Jr.
*Attorney, Agent, or Firm*—John H. Holcombe

[57] ABSTRACT

A low inertia rotary drum transport for flexible sheets, the drum rotating at a relatively low speed for loading a sheet, rapidly accelerating to a relatively high speed for processing the sheet, then rapidly decelerating to the relatively low speed for unloading the sheet. A gate and conveyor are controlled to supply the sheet to the drum in precise registration. Vacuum apparatus and a charge corona are provided for attaching the sheet to the drum, the vacuum attaching the leading portion of the sheet, the corona charging the middle portion of the sheet to hold the sheet to the drum by electrostatic attraction, and the vacuum attaching the trailing portion of the sheet. Air pressure apparatus detaches the leading portion of the sheet for unloading.

19 Claims, 11 Drawing Figures

SHEET FEED AND TRANSPORT

This is a continuation of application Ser. No. 766,403 filed Feb. 2, 1977 now abandoned.

BACKGROUND OF THE INVENTION

1. Field of the Invention

The invention relates to the feeding and transport of flexible sheet material and, more particularly, the feeding and transport of such material on a rotary drum.

2. Description of the Prior Art

Rotary drum transport mechanisms for sheet material appear to attempt to maintain a constant velocity of the drum, especially where processing of the sheet material is involved. Drums having high inertias are therefore often used to reduce the effect of high frequency disturbances on drum velocity.

Such drums are thus used for relatively slow rotational velocity applications where the entire processing of the sheet material is accomplished in one revolution or less and possibly uses only continuous sheet material.

The use of cut sheet material is advantageous in many situations and is required if the processing requires more than one revolution. Cut sheet material further requires mechanisms to feed each sheet onto the drum, register and attach the sheet, and strip the sheet from the drum. None of these steps is trivial. Witness U.S. Pat. No. 3,784,190, Crawford, assigned in common with the present invention, wherein a rotary drum and feeding, processing and stripping of cut sheet material are described.

A way to both increase processing speed and to reduce the machine size is to employ a rotary drum of smaller size and significantly higher speed. Feeding and attaching mechanisms of high to extreme complexity and tolerance are therefore required to accelerate the sheet material, register the sheet material on the rotating drum, attach the sheet material to the rotating drum, strip the processed material from the drum, and decelerate the material.

At the higher speeds, attaching and registering the sheet to the drum while holding the remainder of the sheet against the centrifugal force generated by the rotation becomes important. Vacuum has been employed to attach leading edges of sheet material and occasionally other parts of the sheet, such as the trailing edges. Electrostatic attraction has also been employed to hold insulative sheets, such as paper, to conductive drums at slow speeds, although it has normally been only a by-product of electrophotographic processing. For example, U.S. Pat. Nos. 3,506,259, Caldwell et al, and 3,804,401, Stange, describe mechanisms for separating sheets from a drum to which they are electrostatically attracted. Caldwell et al in particular presents the connotation that such electrostatic "tacking" is a problem. Crawford indicates that separation becomes far more difficult at higher speeds and proposes a solution to the problem.

It is therefore an object of the present invention to provide a sheet feeding, transport and unloading arrangement for a rotary drum which operates at high speed for processing the sheet material.

SUMMARY OF THE INVENTION

Briefly, according to the invention, there is provided apparatus for loading and unloading flexible sheet material to and from a rotary drum for processing at a high rotational speed. The apparatus includes a low inertia rotary drum and a drive means for rapidly accelerating and decelerating the drum between a low load/unload velocity and a high processing velocity. Feeding means supplies the flexible sheet material to the drum and vacuum means attaches the leading edge to the drum. Separating means detaches the sheet from the drum for unloading. Electrostatic charge means applies a charge to the sheet material to attract the material to the drum to overcome centrifugal force thereon and holds portions of the sheet to the drum during the unload phase, keeping the sheet from flying off.

The foregoing and other objects, features, and advantages of the invention will be apparent from the following more particular description of preferred embodiment of the invention, as illustrated in the accompanying drawings.

DESCRIPTION OF THE PREFERRED EMBODIMENT

Figure 1:
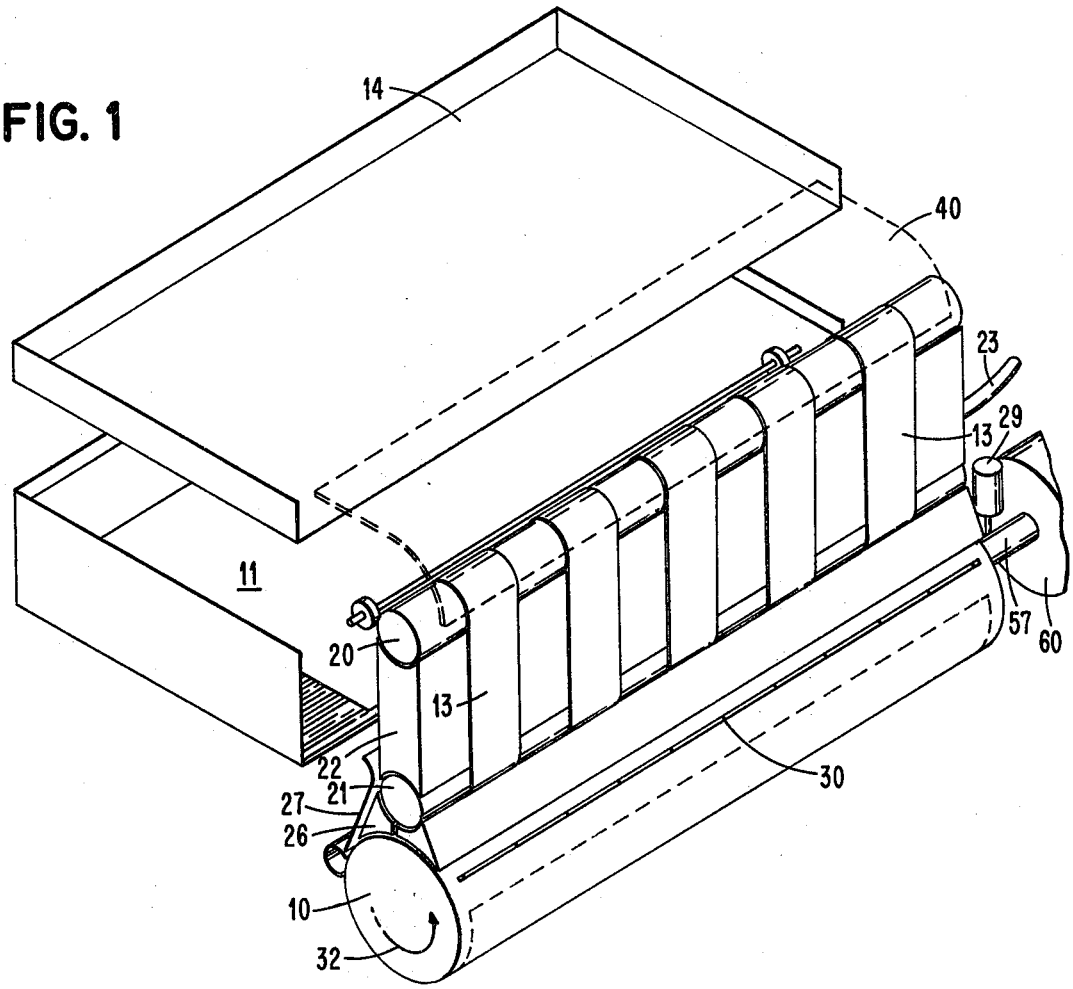
FIG. 1 is an isometric view of the sheet feed and transport of the present invention.
Figure 2:
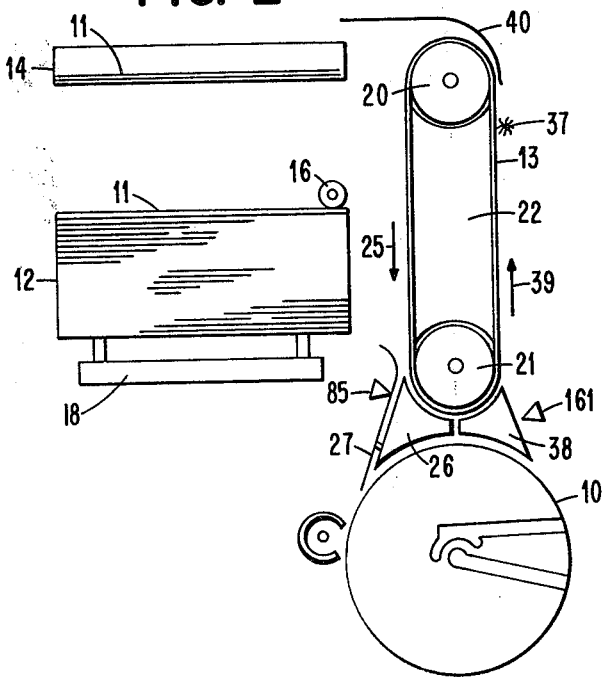
FIG. 2 is a side elevation view of the sheet feed and transport of FIG. 1.

An embodiment of a low inertia rotary drum transport and sheet feed apparatus for loading and unloading flexible sheet material therefrom are illustrated in FIG. 1. A low inertia rotary drum 10 is fed single flexible sheets 11 from bin 12 by conveying belts 13. Processed sheets are fed by the same belts 13 from drum 10 to output bin 14. Referring additionally to FIG. 2, the individual sheets 11 are fed from bin 12 by means of a conventional feed mechanism, such as drive roller 16 outwardly from the bin 12 directly toward belts 13 of the conveyor mechanism as will be explained. The sheets 11 may be biased upwards against feed roll 16 by means of a motor driven elevator mechanism 18.

The conveyor belts 13 are mounted on driving roll 20 and on idle roll 21. Interior to the belts 13 is a vacuum plenum 22 connected by conduit 23 to a source of vacuum.

Sheets 11 from bin 12 are fed by roll 16 towards and perpendicular to belts 13. Belts 13 are driven by drive roll 20 in the direction of arrow 25. As the edge of the sheet 11 contacts belt 13, the motion in the direction of arrow 25 causes the sheet to be deflected downward and to gradually change direction 90° and to come into full contact with the belts 13. Each sheet is held against the belts by the vacuum from the vacuum plenum 22.

Guides 26 and 27 are located between idle roll 21 and drum 10. No vacuum is present in idle roll 21, so that as belts 13 move the sheet to the idle roll it tends to continue in the original direction, thus entering the slot between guides 26 and 27. The guides redirect the sheet outwardly in a direction tangential to the circumference of drum 10.

Figure 3:
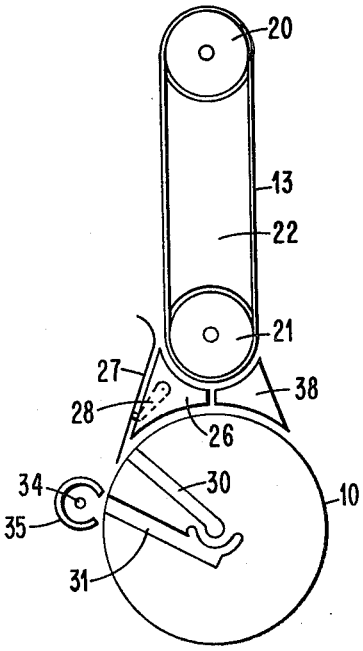
FIG. 3 is a partially cutaway side elevation view of the sheet feed and transport of FIG. 1.

Referring additionally to FIG. 3, guide 26 is further provided with a solenoid operated mechanical gate 28. Such devices are well known in the art. Operation of the solenoid 29 rotates the gate into the sheet path between guides 26 and 27 to stop any sheet from proceeding toward the drum 10. As designated by an appropriate timing signal, gate 28 is rotated out of the guide path so that the belts 13 drive a sheet 11 along the guide path to contact drum 10.

The drum is provided with two conduits 30 and 31 for the transmission of vacuum or pressurized air to the surface of the drum. The timing of the opening of gate 28 is such that the leading edge of a sheet 11 contacts drum 10 to overlie conduit 30. A vacuum is applied to the conduit to attract and hold the leading edge of the sheet to the drum. As the drum rotates in the counterclockwise direction as illustrated by arrow 32, the sheet 11 is drawn from the guide slot formed by guides 26 and 27. The belts 13 are operated at a slightly slower velocity than the surface velocity of drum 10 to prevent buckling of the sheet during loading and to keep it taut.

The drum 10 is coated with a dielectric so that at least the surface contacting the sheet is nonconductive. An activated ionizing corona wire 34 with shield 35 ionizes the surrounding air and directs the ions toward the drum 10. This causes the surface of the drum to become charged. As an insulative sheet 11 is interposed between the corona and drum, the sheet is charged on the side facing the corona at the same polarity as the drum. The side of sheet 11 facing the drum is thus charged to the opposite polarity and is thereby attracted to the drum 10.

As the drum rotates nearly a complete revolution, the trailing portion of sheet 11 is wrapped around the drum and the trailing edge of the sheet overlays conduit 31, to which a vacuum is applied, to hold the trailing edge of the sheet tightly against the drum.

The sheet on drum 10 is thus tightly affixed at the leading and trailing edges by the applied vacuum and the intermediate portions of the sheet are attracted to the drum by means of the applied static charge. The drum 10 may rotate one or many times with the sheet attached in this manner to process the sheet, such as by printing thereon.

A guide 38 is located between drum 10 and idle roll 21. At the completion of processing, and as the leading edge of the sheet 11 approaches the guide, the leading edge vacuum is shut off and pressurized air is applied to conduit 30 to lift the leading edge of sheet 11 from drum 10. This is called a "puff" or "puffing." As the leading edge of the sheet is raised from the surface of drum 10 in this manner, it contacts guide 38 which strips the sheet from the drum and guides it into contact with the belts 13. The electrostatic force continues to hold the remainder of the sheet to the drum as the sheet is stripped off. As before, vacuum plenum 22 draws the sheet 11 into firm contact with belts 13 for transport in the direction of arrow 39. As the sheet is drawn upwards, it passes one or more discharge electrodes 37, which are connected to electrical ground, and which discharge the static electrical charges from the sheet 11. As the sheet reaches drive roll 20, the vacuum is not applied thereat and the sheet continues in its original direction. Guide 40 directs the processed sheet towards bin 14, where it is deposited.

Figure 4:
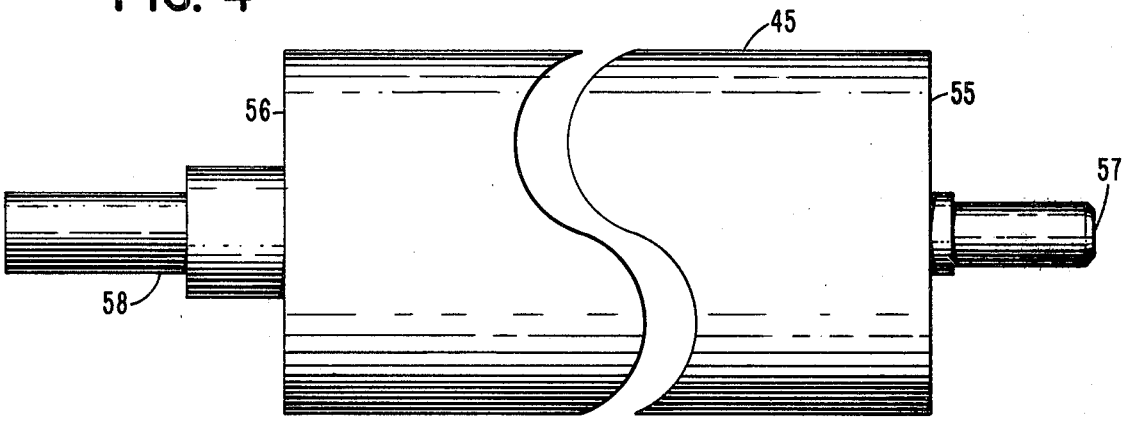
FIG. 4 is a front elevation view of the drum assembly of FIG. 1.
Figure 5:
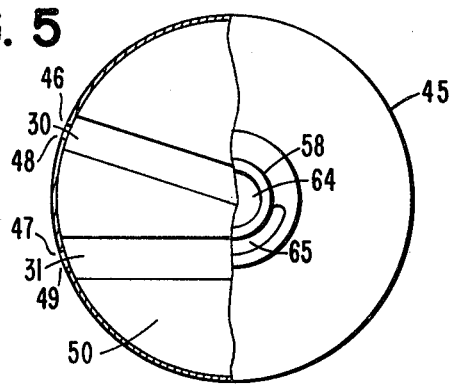
FIG. 5 is a partially cutaway side elevation view of the drum assembly of FIG. 4.
Figure 6:
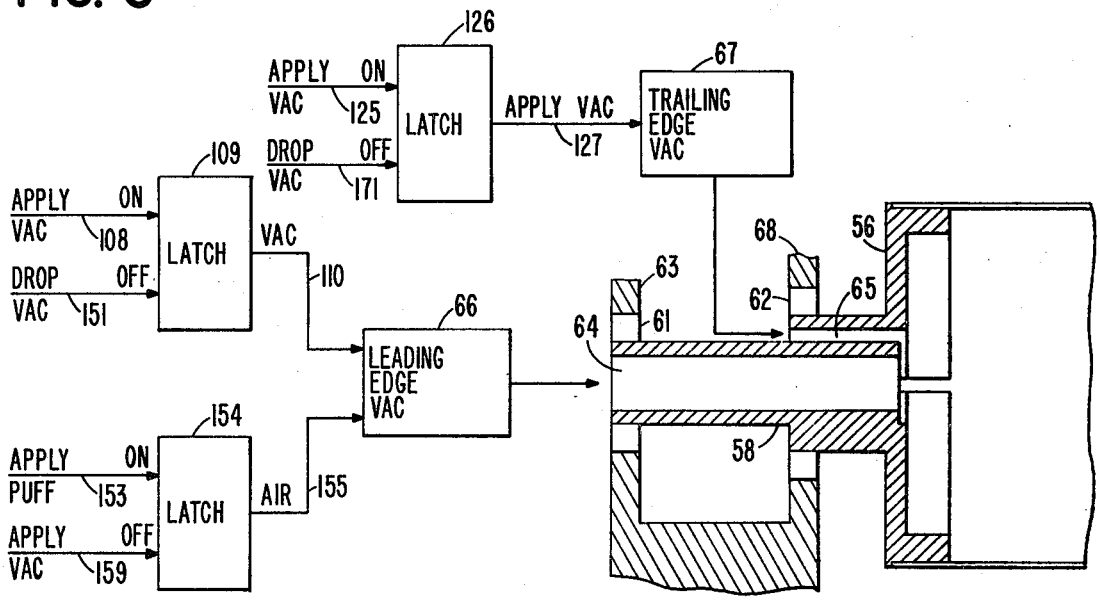
FIG. 6 is a sectional view of the drum assembly of FIG. 5.

Referring to FIGS. 4, 5 and 6, drum 10 is designed to have an extremely low inertia. The drum assembly includes a hollow cylindrical shell 45 having two longitudinal slots 46 and 47 cut in the surface thereof with spaced ports 48 and 49 extending therethrough into the interior of the cylinder. The cylindrical drum surface 45 is preferably made of a strong conductive material, such as a metal. The internal part of the cylinder is occupied by a drum baffle 50 of a lightweight, nonporous material. Conduits 30 and 31 are formed in the baffle and are aligned with the ports 48 and 49, respectively, in the drum surface. The drum is fitted with end caps 55 and 56. The end caps include spindles 57 and 58, which support the drum for rotation in bearings 61 and 62. Spindle 57 is further connected to a servo motor 60 which is arranged to drive the drum as will be explained.

Spindle 58 additionally includes ports 64 and 65 which communicate, respectively, with conduits 30 and 31 in baffle 50. Port 64 communicates with a leading edge vacuum and air source 66 and port 65 is connected to a trailing edge vacuum source 67. Bearing 61 is supported in wall 63 and both separate the vacuum supply to ports 64 and 65. Another wall 68 supports bearing 62 and they separate port 65 from the surrounding atmosphere.

Figure 7:
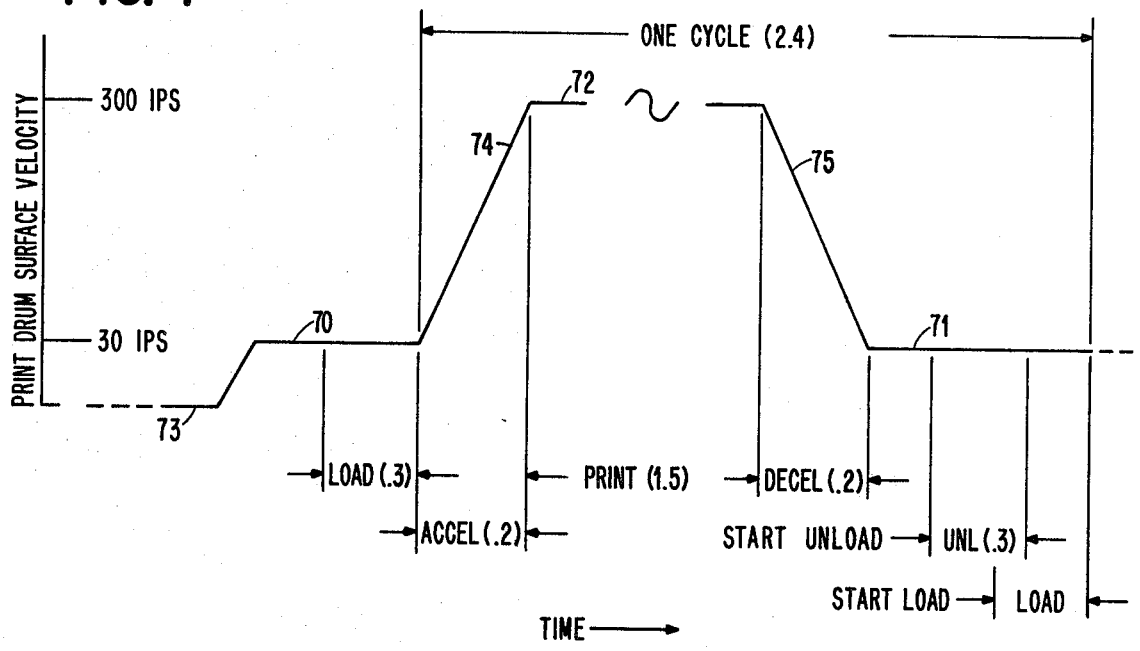
FIG. 7 is a diagrammatic illustration of the velocity profile of the drum of FIG. 1.

Drum 10 is driven in two modes by motor 60. Referring to FIG. 7, the two modes may be characterized as the load mode 70 or 71 and the processing mode 72. Mode 70 represents the loading of an initial sheet 11 on drum 10 after startup 73, and mode 71 represents the operation of unloading a previous sheet from the drum and loading the next sheet onto the drum. Motor 60 cycles the drum between the two modes by means of rapid acceleration 74 and rapid deceleration 75. The rapid acceleration and deceleration can be accomplished most advantageously by having a low inertia drum 10. The low inertia is the result of using lightweight materials, by keeping the drum diameter to a minimum, and by designing the drum as described specifically for low inertia.

FIG. 7 illustrates exemplary speeds and exemplary times for the operation of the servo motor. The exemplary ratio between the load speed and the processing speed is ten to one. This ratio is not critical, but should be sufficiently high to warrant use of a low speed paper handling mechanism at the expense of a low inertia drum and attendant high speed servo.

Figure 8:
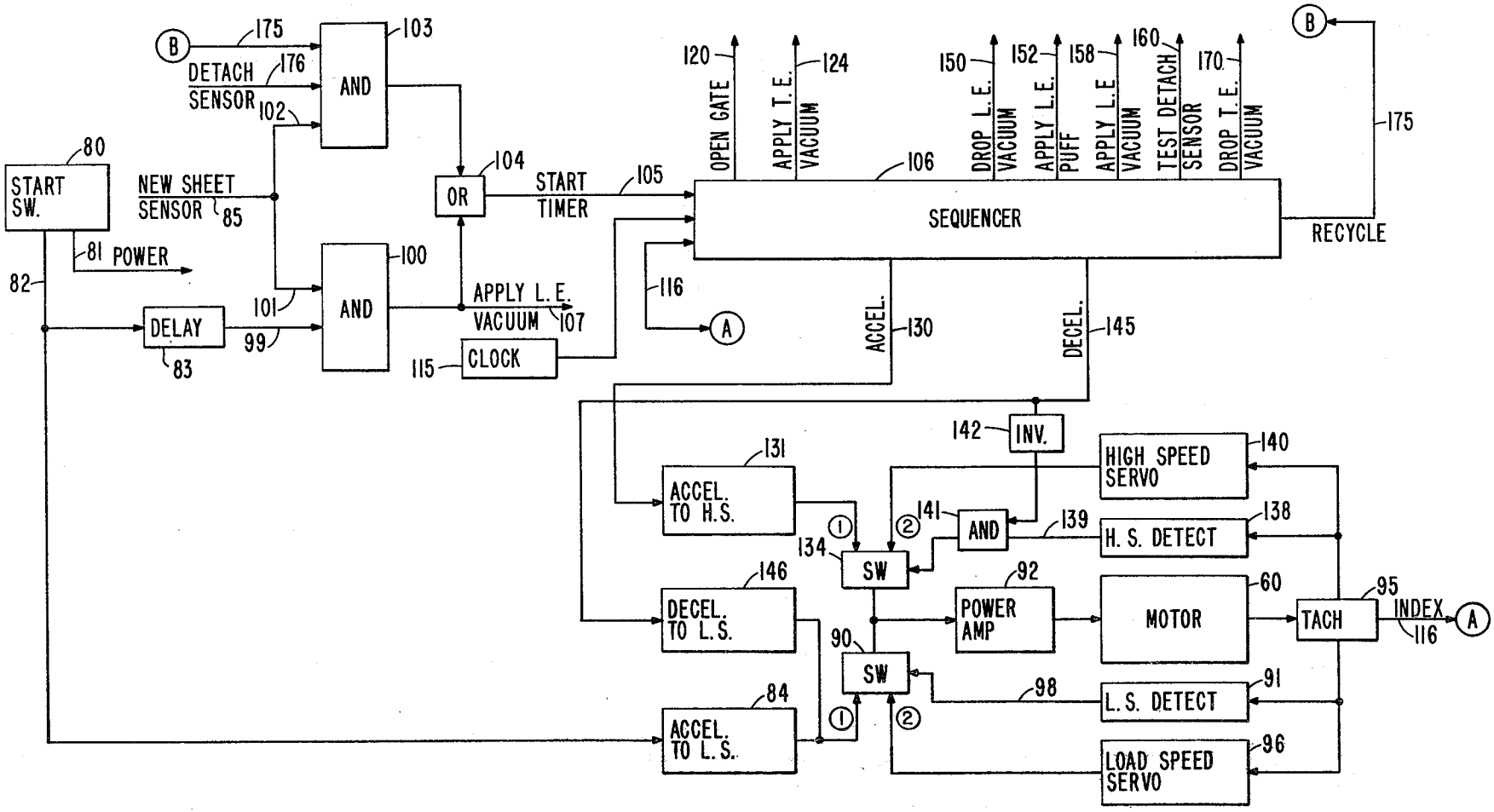
FIG. 8 is a schematic diagram of the drive circuitry for the sheet feed and transport of FIG. 1.

FIG. 8 provides an example of drive circuitry for the sheet feed and transport of the present invention. The specific circuitry for performing the function of driving drum 10 at a slow load speed and at a high processing speed and accelerating and decelerating between the two speeds is dependent upon the accuracy desired. Many alternative arrangements are available or are apparent and may be easily interchanged.

Using FIG. 8 as the example, activation of start switch 80 may supply a signal on line 81 to activate a power supply for supplying power to the various components of the present sheet feed and transport. Specifically activated will be the sheet feed roll 16 in FIG. 2, the conveyor belt mechanism for driving belts 13, and the solenoid to close gate 28. Also activated will be the charge corona 34, the vacuum source for the vacuum plenum 22, and the vacuum and air pressure sources of the leading edge vacuum and air source 66 and the trailing edge vacuum source 67 in FIG. 6. In response thereto, feed roll 16 in FIG. 2 will supply a sheet 11 to be conveyed by belts 13 in the direction of arrow 25 to gate 28. A new sheet sensor 85 detects the presence of a sheet at gate 28. Feed roll 16 will not be operated again until such time as the sensor 85 indicates that the prior sheet has been fed past opened gate 28, such that no part of the sheet remains present at the sensor. Sensing mechanisms of this type and their arrangement with feeding mechanisms are well known and will not be described further.

Start switch 80 in FIG. 8 also supplies a signal on line 82 to delay circuit 83 and to low speed acceleration circuit 84. Circuit 84 generates a specialized acceleration waveform to drive the motor 60 from a stop to the load speed. The output of circuit 84 is supplied to switch 90. The switch is operated by load speed detector circuit 91 to the "1" condition as will be described. The output of circuit 84 is therefore transmitted by switch 90 to power amplifier 92. Amplifier 92 converts the voltage input signal to a drive current to drive motor 60 accordingly. Motor 60 thus accelerates the drum 10 from a stop to the load speed in accordance with the signal from circuit 84.

Motor 60 is connected to tach 95 which supplies a tach signal to load speed detector circuit 91 and to load speed servo circuitry 96. Load speed detector circuit 91 is one of many commonly available circuits and is switched into operation when the pulse rate from tach 95 is within a specified percentage of the desired load speed. An example of such a circuit may be a pretuned filter. When the pulse rate enters the desired frequency band, the circuit provides a signal on line 98 to operate switch 90 from condition "1" to condition "2." When in condition "1," switch 90 connects input "1" to the output, and when in condition "2," switch 90 connects input "2" to the output. In the absence of a signal on line 98, switch 90 reverts back to the "1" condition.

In the "2" condition, switch 90 supplies the output of load speed servo 96 to power amplifier 92. Load speed servo 96 may be any type of fine tuning or servoing circuitry for maintaining the speed of motor 60 and drum 10 within defined limits. An exemplary servo circuit will be described hereinafter. After a sufficient time for motor 60 to reach the load speed, delay circuit 83 supplies a signal on line 99 to AND circuit 100. The other input to AND circuit 100 is the output of sensor 85 in FIG. 2. This output indicates that a new sheet is in position at gate 28 and is supplied to line 101 of AND circuit 100 and to line 102 of AND circuit 103.

Assuming a new sheet is in position, AND circuit 100 supplies a signal via OR circuit 104 and line 105, to a sequencer or timer 106, and on line 107 which is connected to input 108 of latch 109 in FIG. 6.

In response to the signal at input 108, latch 109 provides a signal on line 110 to the leading edge of vacuum and air source 66. This signal operates the source to supply a vacuum, via port 64, to the leading edge conduit 30 in FIG. 3. Alternatively, the air source 66 controlled by latch 109 may be normally on and shut off by operation of the latch.

In FIG. 8, sequencer 106 is also connected to high frequency clock 115 and to the index output 116 of tach 95. The frequency of clock 115 is several hundred times the revolution speed of drum 10. The index signal on line 116 occurs once per drum revolution and indicates a specific rotational position of the drum 10. The index pulse is used by sequencer 106 to set the proper phase of the sequencer as it counts out the clock pulses received from clock 115.

Sequencer 106 may comprise many various types of available units. One example may comprise a sequential shift register responding to the clock pulses from clock 115 to sequence a position each clock pulse. Specific ones of the shift register outputs will hold until ANDed with an index pulse before sequencing to the next position for phase adjustment.

Sequencer 106 first supplies an output on line 120 to operate the solenoid of gate 28 to open the gate. The sheet 11 held by gate 28 is thus fed towards drum 10 in a precise relationship with the position of the drum while rotating such that the leading edge of the sheet 11 contacts and is held in place by the vacuum in leading edge conduit 30. Drum 10 continues to rotate, pulling sheet 11 from the guides 26 and 27, and wraps the sheet about the drum as the drum rotates. During this time, the ionization from corona 34 creates a charge on the insulated sheet to hold the sheet against drum 10. At a later time, sequencer 106 supplies a signal on line 124 to input 125 of latch 126 in FIG. 6. This signal sets the latch so that it supplies a signal on line 127 to operate the trailing edge vacuum source 67. Vacuum source 67 then supplies a vacuum, via port 65, to trailing edge conduit 31 in FIG. 3. This vacuum draws in and holds the trailing edge of sheet 11. Sequencer 106 then supplies a signal on line 130 to circuit 131. Circuit 131 generates a specific waveform to accelerate motor 60 and drum 10 from the load speed to the high speed within a relatively short time span. This waveform is supplied on line 132 to switch 134. The controlling input to switch 134 is supplied by high speed detector circuit 138 on line 139, via AND circuit 141. As no signal is present on line 145, inverter 142 supplies a gating signal to the AND circuit.

High speed detector 138 is similar to low speed detector circuit 91, except that it operates at a significantly higher frequency. So long as motor 60 and drum 10 are not at the high speed, no signal is supplied on line 139 and switch 134 is in the "1" condition. In that condition, the switch connects the line 132 to power amplifier 92. Power amplifier 92 thus responds to the waveform from circuit 131 to drive motor 60 to accelerate from the load speed to the high speed. Upon reaching the approximate high speed, circuit 138 supplies a signal on line 139, gated by AND 141, to switch 134. The switch then disconnects input "1" and connects input "2" to power amplifier 92. Input "2" is connected to high speed servo 140.

High speed servo 140 may be any suitable servo circuit for maintaining the speed of motor 60 and drum 10 within the requirements of the processing required. Many examples of such servos exist, and one example is particularized hereinafter. Upon completion of the sequencing for the processing step, sequencer 106 supplies an output signal on line 145 to circuit 146. As motor 60 and drum 10 are not operating at the load speed, detector 91 is providing no signal on line 98, and switch 90 is therefore in the "1" state. The output of circuit 146, which is a deceleration waveform, is provided by the switch 90 to power amplifier 92. The signal on line 145 is also inverted by inverter 142 to block AND circuit 141 so that no signal is applied from the detector circuit 138 to switch 134. Switch 134 thus switches back to the "1" state and terminates application of the servo drive signal to power amplifier 92. Power amplifier 92 thus responds to the output of circuit 146 by decelerating motor 60 and drum 10 to the load speed. The load speed detector 91 and load speed servo 96 thus function as previously described and take over the drive of motor 60.

Sequencer 106 then applies a signal on line 150 to input 151 of latch 109 in FIG. 6. This signal turns off latch 109 and terminates the signals therefrom on line 110 to leading edge vacuum source 66. The result of the operation is to terminate the supply of vacuum to port 64 and to conduit 30 in FIG. 3.

Next, sequencer 106 supplies a signal on line 152 to input 153 of latch 154 in FIG. 6. This operates leading edge vacuum and air source 66 to supply air under pressure via port 64 and conduit 30 in FIG. 3 to lift the leading edge of the processed sheet 11 from the surface of the drum 10. As the leading edge of the sheet is raised from the surface of the drum, guide 38 intercepts the leading edge of the sheet and strips the sheet from the drum as the drum rotates. The electrostatic charge holds the sheet to the drum as the stripping occurs, keeping the sheet from flying off.

Next, sequencer 106 supplies an output on line 158 to input 108 of latch 109 in FIG. 6, and to input 159 of latch 154 in the same figure. This signal thus turns off latch 154 and turns on latch 109. The resultant presence of a signal on line 110 and absence of a signal on line 155, causes the leading edge vacuum and air source 66 to switch from supplying air pressure to supply a vacuum to port 64 and to conduit 30 in FIG. 3. With the leading edge vacuum thus applied, a subsequent sheet may be gated onto the drum.

Sequencer 106 then supplies a signal on line 160 to operate sensor 161 in FIG. 2 to detect the presence of the leading edge of sheet 11 on guide 38. Should sensor 161 fail to detect the presence of a sheet, a failure will have occurred. Any of various possible failure modes may then be initiated, ranging from a simple retry of the leading edge puff to a power shutdown.

Assuming no failure indication, sequencer 106 then provides a signal on line 170 to input 171 of latch 126. This causes the latch to turn off and to discontinue the signal on line 127, thereby terminating operation of the trailing edge vacuum source 67. Vacuum is thus no longer applied via port 65 and conduit 31 to hold the trailing edge against drum 10. This frees the trailing edge of the sheet 11 from the drum and allows the sheet to be drawn away from the drum by belts 13 of the conveyor system. Also, for subsequent sheets, the leading edge has the full vacuum supplied by the vacuum source common to both leading edge and trailing edge.

Sequencer 106 then supplies a signal on line 175 so that the sequencer may act similarly to a ring circuit and recycle. Line 175 comprises one of the inputs to AND circuit 103. The other inputs to the AND circuit comprise the output from sensor 80 in FIG. 2 which indicates a new sheet is present at the gate 28, and line 176 which is connected to the output of sensor 161, which indicates that the previous sheet was detached from the drum.

Again assuming that a failure mode was not entered, the detach sensor supplies an output signal on line 176, and assuming a new sheet is present, the new sheet sensor supplies an output at input 102 of AND circuit 103. In this situation, the recycling signal on line 175 is transmitted by the AND circuit 103 and OR circuit 104 to input 105 of the sequencer 106, thereby initiating another load and processing sequence. The loading and processing and unloading of sheets may continue in this fashion until a new sheet is no longer available at gate 28. The system will then idle until such time as start switch 80 is again operated. Assuming that the motor and drum remain idling at the load speed and that the power remains on, operation of start switch 80 results in generation of the waveform of circuit 84 but which will be blocked by switch 90 due to its activation by the signal on line 98 to the "2" condition. After appropriate delay by circuit 83, however, the start signal is applied on line 99 to AND circuit 101 in conjunction with an indication at input 101 of the presence of a new sheet, loading and processing of a new sheet will begin.

Figure 9:
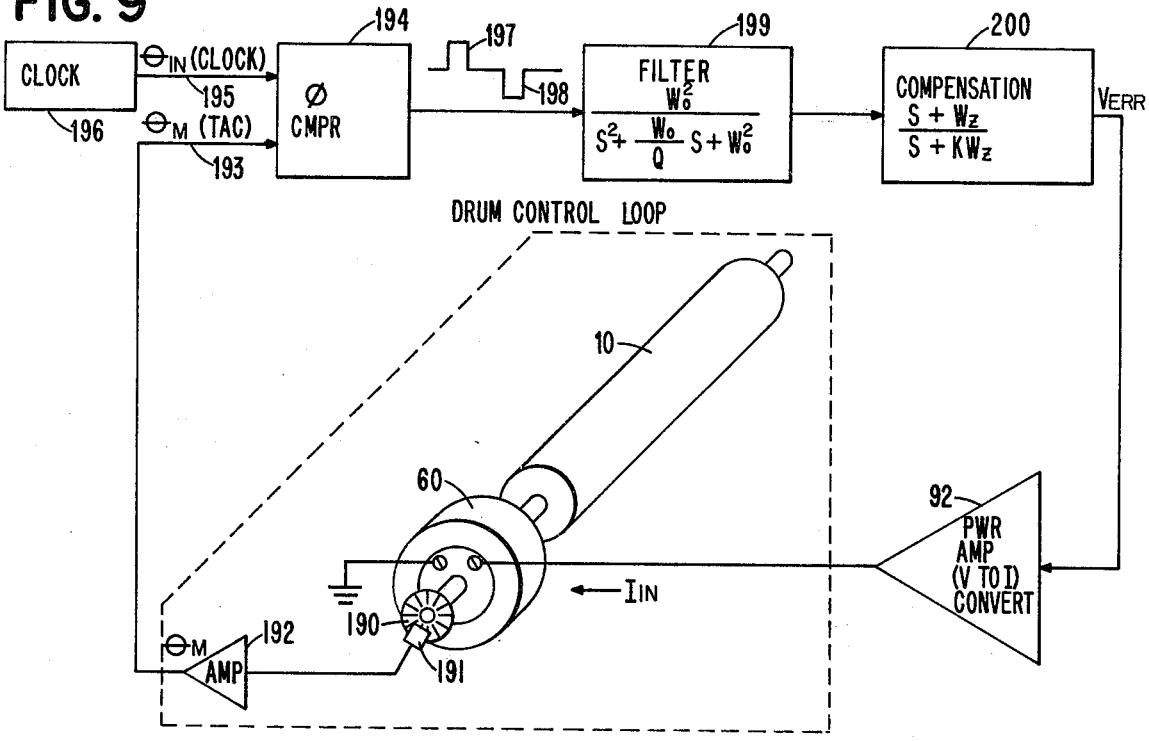
FIG. 9 is a schematic diagram of the servo circuits of FIG. 8.

FIG. 9 illustrates an exemplary servo system that may be employed as high speed servo 140 and as load speed servo 96 in FIG. 8. As illustrated in FIG. 9, the tach 95 attached to motor 60 and drum 10 may comprise an index wheel 190, a sensor 191, and an amplifier 192. The resultant tach pulses are supplied to input 193 of phase comparator 194. Input 195 of the phase comparator is connected to a clock 196. Clock 196 is arranged to provide pulses at precisely the pulse rate which would be derived by sensor 191 if motor 60 were running at precisely the correct rotational velocity. Phase comparator 194 thus produces a wave form of interspersed positive clock pulses 197 and negative tachometer pulses 198. The waveform is run through a low path and phase correction filter 199. The resultant voltage signal indicates by its polarity, the direction, and by its amplitude, the amount, of error adjustment to be made. This signal is supplied to gain compensation circuit 200 which supplies the compensated adjustment signal via the appropriate switch in FIG. 8 to power amplifier 92.

Figure 10:
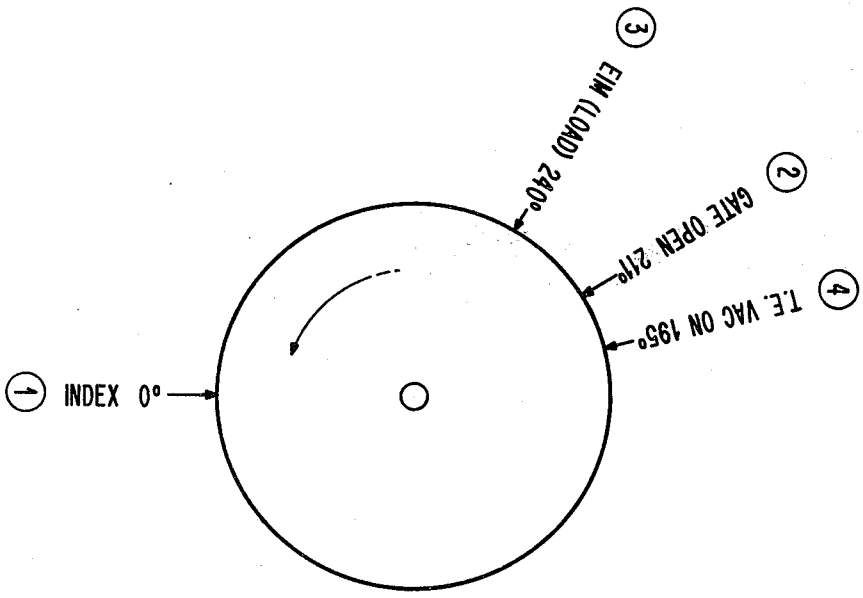
FIG. 10 is a diagrammatic illustration of the operation of the sheet feed and transport of FIG. 1 during sheet loading.
Figure 11:
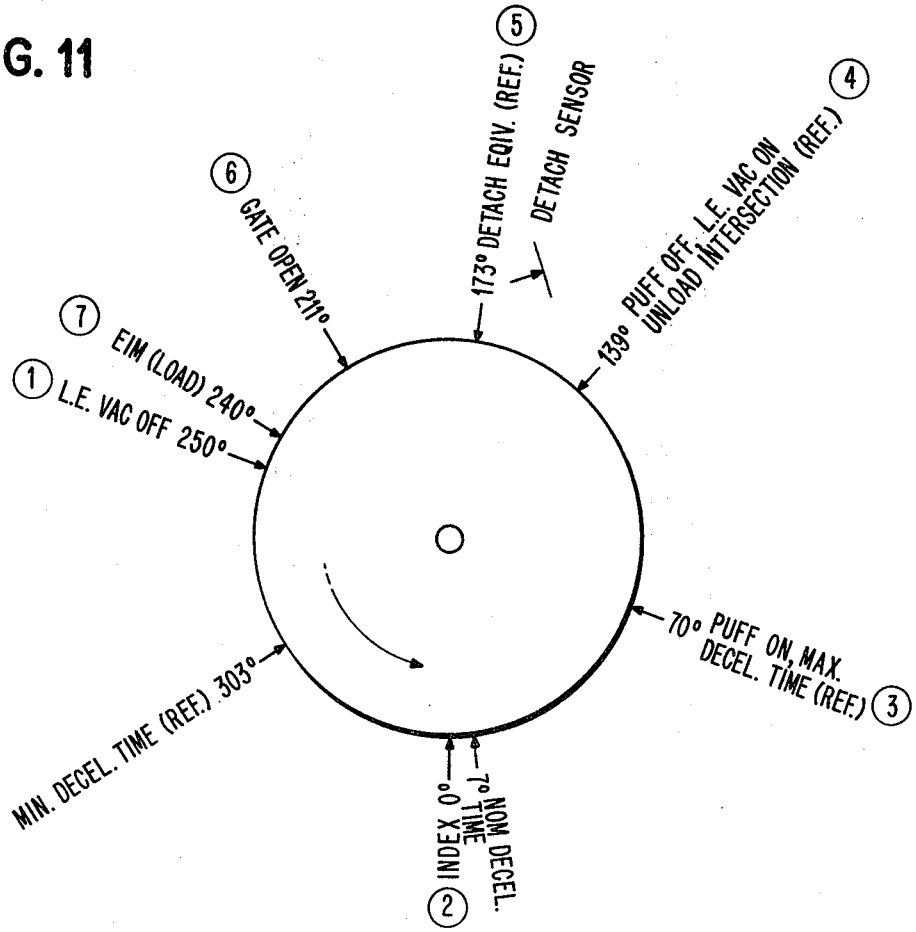
FIG. 11 is a diagrammatic illustration of the operation of the sheet feed and transport of FIG. 1 during repeat cycle sheet unloading.

FIGS. 10 and 11 illustrate specific examples of the sequence of various operations and the angular positions of the drum at the moment of such operations. This information may be employed in the arrangement of sequencer 106 in FIG. 8.

FIG. 10 illustrates the operations resulting from operation of start switch 80 after the motor and drum have been accelerated to the load speed. First, the index mark is sensed and employed to synchronize sequencer 106. Second, sequencer 106 provides a signal on line 120 to open gate 28 in FIG. 3. Third, the leading edge of the gated sheet 11 will be attracted and held to the surface of drum 10 by the leading edge vacuum applied as the result of the signal on line 107 by the start switch 80 in FIG. 8. Fourth, sequencer 106 supplies a signal on line 25 to actuate the trailing edge vacuum during the second revolution of the drum from the index point.

Referring to FIG. 11, the operation for unloading a processed sheet of paper from the drum 10 and the operations to initiate loading of the next sheet are illustrated. First, sequencer 106 supplies a signal on line 150 to drop the leading edge vacuum. Second, the index point is sensed and a signal supplied on line 116 to synchronize the sequencer 106. Third, sequencer 106 supplies a signal on line 152 to apply the puff of air pressure. Between the time that the leading edge vacuum has been turned off in step one, and the air puff has been provided in step three, the motor 60 and drum 10 will have decelerated from the high speed to the load speed. By step four, the leading edge of the sheet 11 will have engaged guide 38 in FIG. 1. Thus, at step four, the sequencer 106 supplies a signal on line 158 to discontinue the air pressure puff and to turn the leading edge vacuum on. Fifth, sequencer 106 supplies a signal on line 160 to test the detach sensor 161 in FIG. 2. Assuming that a new sheet is available to be loaded and the detach sensor does not indicate a failure, a recycle signal on line 175 will be supplied at input 105 to the sequencer and reinitiate operation of the sequencer to supply a signal on line 120 to open the gate 28 in FIG. 3. At step seven, the leading edge of the new sheet 11 is loaded by the leading edge vacuum to the surface of the drum 10. Control of the trailing edge vacuum is optional depending upon the ability of guide 38 to strip off the trailing edge of the document.

Although the steps of FIGS. 10 and 11 are shown very precisely, variations of the angles of rotation may be used for various circumstances. For example, the "puff" step 3 of FIG. 11 may be accomplished at a much earlier point if the "lift" response time of the leading edge of the sheet is slow.

While the invention has been particularly shown and described with reference to a preferred embodiment thereof, it will be understood by those skilled in the art that various changes may be made therein without departing from the spirit and scope of the invention.

What is claimed is:

1. Apparatus for feeding and transporting flexible sheet material comprising:

a rotary drum having a low inertia for rapid acceleration and deceleration thereof;

drive means connected to said rotary drum for driving said drum at a low load/unload velocity, for driving said drum at a high processing velocity, and for rapidly changing from one velocity to the other;

first guide means for guiding said flexible sheet material to the surface of said rotary drum;

gate means for holding said flexible sheet material at said first guide against forward movement and for releasing said sheet at a predetermined time;

conveyor means for urging said flexible sheet forward into engagement with said gate means and for urging said released sheet along said guide means in predetermined relationship with the position of said drum such that said guide means guides said sheet into registration on the surface of said rotary drum as said drum is driven at said low velocity;

means for attaching said flexible sheet material to the surface of said rotary drum to load said drum while said drum is rotated at said load/unload velocity;

said drive means accelerating said sheet loaded drum to said processing velocity for processing said sheet and thereafter decelerating said drum to said load/unload velocity;

means for detaching said sheet from the surface of said rotary drum while said drum is rotated at said load/unload velocity;

second guide means for guiding said detached sheet away from said drum; and means for controlling the sequence and timing of the operations of said drive means, said gate means, said attachment means, and said detaching means wherein said gate means is controlled to release said sheet to said rotary drum at said predetermined time established by said controlling means in accordance with the angular position of said rotary drum.

2. The apparatus of claim 1 wherein said attachment means comprises:

vacuum means for attaching the leading portion of said sheet to the surface of said rotary drum during loading and for releasing said leading portion during unloading; and corona means for electrostatically charging said sheet to hold said sheet to the surface of said rotary drum by electrostatic attraction during unloading.

3. The apparatus of claim 2 wherein said attachment means additionally comprises:

vacuum means for attaching the trailing portion of said sheet to the surface of said rotary drum.

4. The apparatus of claim 2 wherein said detaching means comprises:

fluid pressure means for applying fluid to the leading portion of said attached sheet to detach said sheet from the surface of said drum.

5. The apparatus of claim 1 wherein said conveyor means additionally comprises:

means for moving said sheet toward said rotary drum at said first guide means and away from said rotary drum at said second guide means, respectively.

6. The apparatus of claim 1 wherein said low inertia rotary drum comprises:

a hollow cylinder forming the surface of said drum; and two end caps each having a spindle for mounting said drum for rotation.

7. Apparatus for feeding and transporting flexible sheet material at a rotary processing station comprising:

a low inertia drum forming at least part of said rotary processing station and comprising a hollow cylinder forming the surface of said drum, and two end caps each having a spindle for mounting said drum for rotation;

drive means connected to said rotary drum for driving said low inertia drum at a low load/unload velocity, for driving said low inertia drum at a high processing velocity, and for rapidly accelerating and decelerating said low inertia drum between said velocities;

conveyor means for urging said flexible sheet material forward toward said low inertia drum at a predetermined rate;

gate means for holding said flexible sheet material against forward movement by said conveyor means, whereby said sheet material is engaged by said conveyor means and maintained in position against said gate, and for releasing said flexible sheet material at a predetermined time for urging by said conveyor means at said rate toward said surface of said low inertia drum in precise relationship with the position of said drum for registration thereon while said drum is rotated at said load/unload velocity;

means for attaching said flexible sheet material to said surface of said low inertia drum to load said drum while said drum is rotated at said load/unload velocity;

said drive means accelerating said sheet loaded drum to said processing velocity for processing said sheet and thereafter decelerating said drum to said load/unload velocity;

means for detaching said sheet from the surface of said rotary drum while said drum is rotated at said load/unload velocity; and sequence controlling means for controlling said gate means to release said flexible sheet material at said predetermined time in accordance with the angular position of said rotary drum.

8. The apparatus of claim 7 wherein said drive means additionally comprises:

servo means for controlling said high processing velocity of said low inertia drum.

9. The apparatus of claim 7 wherein said attachment means comprises:

vacuum means for attaching the leading portion of said sheet to said surface of said low inertia rotary drum, said vacuum means comprising:

a source of vacuum;

conduit means internal to said hollow cylinder and extending therethrough to said surface of said drum; and connection means connecting said source of vacuum to said conduit means.

10. The apparatus of claim 9 wherein said connection means additionally comprises:

a port extending through one of said end caps of said low inertia drum.

11. The apparatus of claim 9 wherein said attachment means additionally comprises:

ionization means for electrostatically charging said sheet to hold said sheet to said surface of said low inertia drum by electrostatic attraction.

12. The apparatus of claim 9 wherein said attachment means additionally comprises:

vacuum means for attaching the trailing portion of said sheet to said surface of said rotary drum.

13. The apparatus of claim 7 wherein said detaching means comprises:

fluid pressure means for applying fluid to the leading portion of said attached sheet to detach said sheet from said surface of said drum.

14. Apparatus for transporting flexible sheet material comprising:

a transport means having a surface for transporting said flexible sheet material;

conveyor means for engaging and urging said flexible sheet material forward towards said transport means at a predetermined rate in precise relationship with said transport means;

gate means for holding said sheet material against said forward movement by said conveyor means, thereby maintaining said sheet material in position against said gate, and for releasing said sheet for urging by said conveyor means toward said surface of said transport means for attachment;

a source of vacuum and of fluid pressure;

conduit means extending to said surface of said transport means;

connection means connecting said source of vacuum and of fluid pressure to said conduit means;

means for controlling the operation of said gate means to release said sheet at a predetermined time for urging by said conveyor means toward said surface of said transport means at said rate and in precise relationship with the position of said transport means to properly register said sheet on said surface during movement thereof, and for controlling the sequence and timing of said source of vacuum and of fluid pressure to first supply said vacuum to attach said flexible sheet material to said surface of said transport means and subsequently drop said vacuum and supply said pressurized fluid to detach the leading portion of said sheet from said surface of said transport means; and corona means for electrostatically charging said attached sheet to hold the remainder of said sheet to said surface of said transport means upon said detaching of said leading portion thereof.

15. A method for supplying flexible sheet material for processing at a rotary processing station including a low inertia rotary drum comprising the steps of:

urging said flexible sheet forward toward said drum;

holding said flexible sheet material stationary in position at a gate against said forward urging;

rotating said drum at a low load velocity;

releasing said flexible sheet material from said gate toward said drum at a predetermined relationship with the position of said drum;

urging said flexible sheet material to said drum in precise relationship therewith for registration of said flexible sheet material with said rotary drum while said drum is being rotated at said low load velocity;

loading said released flexible sheet material on said drum while said drum is being rotated at said low load velocity;

accelerating said drum to a high processing velocity;

rotating said drum at said high processing velocity for processing said flexible sheet material;

decelerating said drum to a low unload velocity;

rotating said drum at said low unload velocity; and unloading said flexible sheet material from said drum while said drum is being rotated at said low unload velocity.

16. The method of claim 15 wherein:

said loading step additionally comprises the first step of guiding said sheet to the surface of said drum; and said unloading step comprises the steps of:

detaching the leading edge of said processed sheet from the surface of said drum;

attracting the remainder of said processed sheet to the surface of said drum; and guiding said detached sheet from the surface of said drum.

17. The method of claim 15 wherein:

said low load velocity and said low unload velocity are the same velocity; and said loading step is repeated for a subsequent sheet.

18. The method of claim 15 wherein:

said loading step comprises the steps of:

guiding said sheet to the surface of said drum;

supplying vacuum to the surface of said drum to attach the leading portion of said sheet to the surface of said drum; and electrostatically attracting said sheet to the surface of said drum; and said unloading step comprises the steps of:

detaching the leading portion of said processed sheet from the surface of said drum, the remainder of said processed sheet remaining attracted to the surface of said drum by said electrostatic attraction; and guiding said detached sheet from the surface of said drum.

19. The method off claim 18 wherein:

said loading step additionally comprises the step of supplying vacuum to the surface of said drum to attach the trailing portion of said sheet to the surface of said drum; and said detaching step comprises:

supplying pressurized fluid to the surface of said drum to detach the leading edge of said processed sheet from the surface of said drum.

* * * * *

UNITED STATES PATENT AND TRADEMARK OFFICE

CERTIFICATE OF CORRECTION

PATENT NO. : 4,252,307

DATED : February 24, 1981

INVENTOR(S) : Eugene C. Korte

It is certified that error appears in the above—identified patent and that said Letters Patent is hereby corrected as shown below:

Column 7, Line 60, "80" should read --85--.
Column 8, Line 53, "25" should read --125--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*